United States Patent [19]

Cleyet et al.

[11] Patent Number: 5,032,126

[45] Date of Patent: Jul. 16, 1991

[54] DEPILATING APPLIANCE

[75] Inventors: Aimé Cleyet, Lyon; G. Gabion, Rillieux; R. Roger, Lyon; Jacques Demeester, Croissy Sur Seine; Yves Vatelot, Paris, all of France

[73] Assignees: Jacques Demeester, Croissy Sur Seine; Yves Vatelot, Paris, both of France; part interest to each

[21] Appl. No.: 416,318

[22] Filed: Oct. 3, 1989

[30] Foreign Application Priority Data

Oct. 14, 1988 [FR] France ..... 88 13542

[51] Int. Cl.[5] ..... A61B 17/00

[52] U.S. Cl. ..... 606/133

[58] Field of Search ..... 606/133; 17/11.1 R, 17/47; 452/82-85

[56] References Cited

U.S. PATENT DOCUMENTS 4,830,004 5/1989 Alazet ..... 606/133

FOREIGN PATENT DOCUMENTS 0147285 7/1985 European Pat. Off. .
1028384 5/1953 France .
2556989 6/1985 France .
461572 2/1937 United Kingdom ..... 17/11.1 R

*Primary Examiner*—Michael H. Thaler
*Attorney, Agent, or Firm*—Young & Thompson

[57] ABSTRACT

The depilating appliance comprises a series of hair-plucking grippers constituted by blades movably mounted on a support plate which is driven in rotation about a central shaft at right angles to the plate. The blades are disposed radially in one or a number of rows and placed in each row at right angles with respect to the corresponding radius of rotation. The blades are movably mounted on their support plate so that their free edges can be applied against each other or opened-out in the alternate sequence. During rotation of the support plate, closing and opening of the grippers take place at least once per revolution.

13 Claims, 4 Drawing Sheets

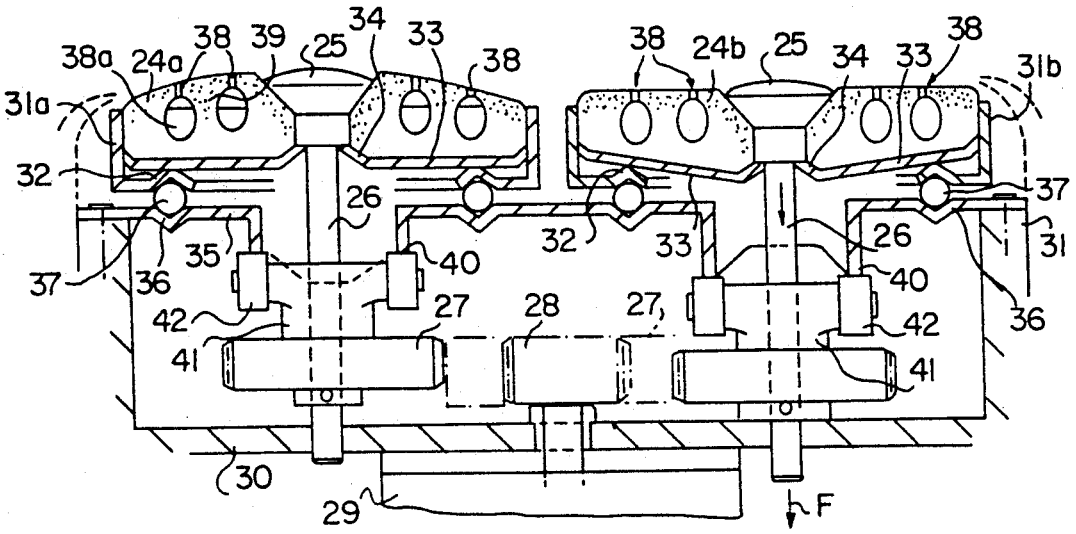
FIG. 6
FIG. 7
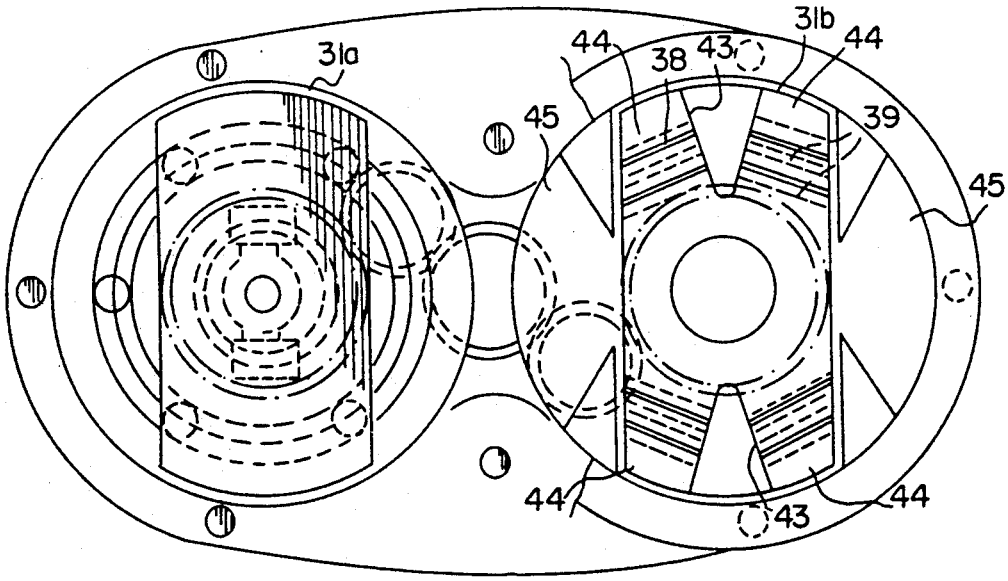

DEPILATING APPLIANCE

BACKGROUND OF THE INVENTION

1. Field of the Invention

The present invention relates to small depilating appliances which can be held in one hand for the removal of superfluous hairs.

2. Description of the Prior Art

Certain current appliances of this type such as, for example, the appliance described in French patent No. 2,556,939, comprise a rotary depilating roller for plucking-out the hairs to be removed. This depilating roller is formed by a series of thin disks placed side by side with a small clearance between them, mechanical actuating means being provided in addition for periodically gripping hairs which have engaged between said disks. The hairs are then plucked-out as a result of rotation of the depilating roller.

However, by reason of the very fact that the gripping blades are arranged in the form of a roller rotatably mounted about an axis parallel to the skin, appliances of this type call for a high degree of accuracy in the conditions of separation and gripping of said blades in order to ensure that the hairs to be removed engage correctly between these latter and are gripped in an effective manner. This accordingly entails the need for relatively complex means for controlling the blades as well as very high machining accuracy. Moreover, appliances of the type concerned also have the disadvantage of causing frequent breakage rather than pulling-out of hairs, this being also due to the fact that the gripping blades are arranged in the form of a rotary roller.

SUMMARY OF THE INVENTION

It is for the reasons given above that the object of the invention is to provide a depilating appliance in which gripping blades are again provided but are arranged in an entirely different manner in order to overcome the disadvantages of the appliances recalled in the foregoing.

In the same manner as the appliances recalled earlier, the depilating appliance in accordance with the invention comprises a series of hair-plucking grippers constituted by blades carried by a movable support, said blades being driven in movements which cause them successively to be applied against each other with a view to gripping the hairs to be plucked-out and to open-out so as to permit the preliminary introduction of said hairs between said blades. However, said appliance is distinguished by the fact that :

the support for the gripping blades constituting the hair-plucking grippers consists of a member having a flat general shape and driven in a movement of rotation about a central shaft at right angles to said member, the gripping blades are mounted on said support in the form of one or a number of rows disposed radially, are placed in each row at right angles with respect to the corresponding radius of rotation, and are movably mounted in such a manner as to ensure that their free edges can be alternately applied against each other or opened-out, means are provided for actuating said blades and are capable of causing the grippers constituted by said blades to open and close at least once per revolution.

In the appliance considered, the free edges of the gripping blades are located in the same plane which is intended to constitute the surface of application of said appliance on the skin. The hairs to be removed are caused to engage easily between the ends of said blades when these latter are separated from each other. Said hairs are accordingly gripped between said blades when they close and are then plucked-out by virtue of the fact that said blades remain tightly applied against each other during a predetermined fraction of each revolution of the blade support.

In accordance with another distinctive feature of the appliance considered, the means for actuating the movable blades constituting the hairplucking grippers are constituted in the case of each row of blades by two flat bars slidably mounted on the rotary support of said blades and driven in movements of translation in opposite directions, said flat bars being each provided with a fork or the like in which is engaged a portion of the corresponding blade to be actuated.

In an advantageous embodiment of the depilating appliance in accordance with the invention, the movable blades constituting the hair-plucking grippers are flat and have the general shape of arches which are pivotally mounted at their ends on the blade support, the actuating bars being capable of initiating the pivotal displacement of said blades alternately in one direction and in the other so as to close the grippers constituted by the ends of said blades.

BRIEF DESCRIPTION OF THE DRAWINGS

FIG. 6 is a view which is similar to FIG. 1 but shows yet another embodiment of the depilating appliance in accordance with the invention.

FIG. 7 is a top view of said appliance.

DESCRIPTION OF THE PREFERRED EMBODIMENTS

Figure 1:
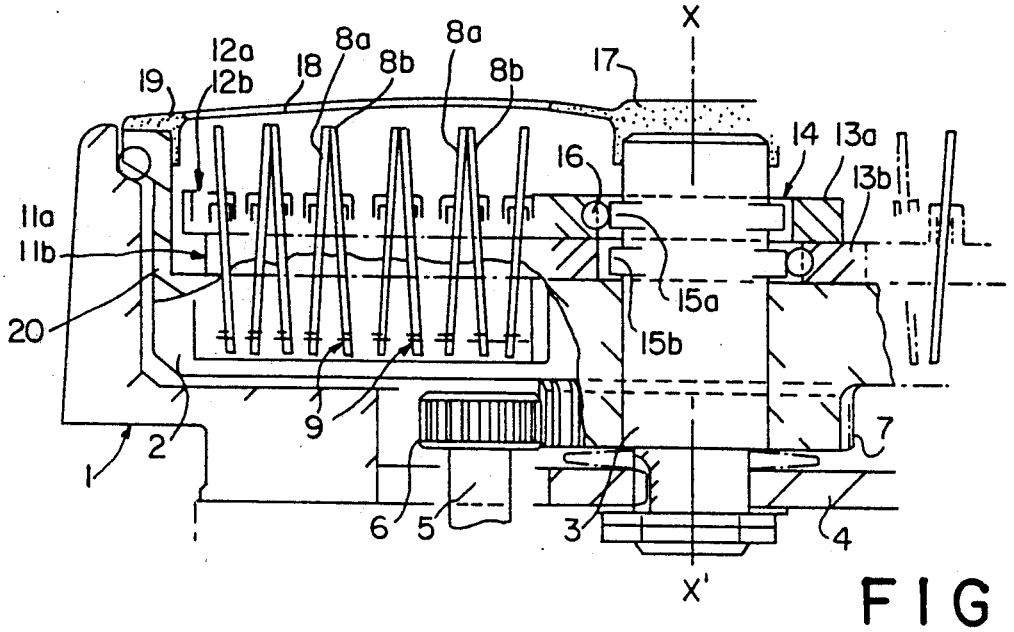
FIG. 1 is a schematic fragmentary axial sectional view of the working head of a depilating appliance in accordance with the invention.

The working head of the appliance shown by way of example in FIGS. 1 to 4 comprises a rigid body 1 having the general shape of a cup which is added at the end of a casing (not shown) containing the electric motor of the appliance. Said casing is intended to be hand-held in order to displace the working head in contact with the skin. Against the bottom wall 4 of the body 1, provision is made for a plate 2 having a generally rectangular shape and rotatably mounted on a stationary central shaft 3 which is perpendicular to the plate. Said plate 2 is driven in rotation by means of a rotary shaft 5 which is in turn coupled with the output shaft of the motor, the end of said shaft being provided with a pinion 6 disposed in meshing engagement with the toothed wheel 7 carried by the rotary plate 2.

Said rotary plate serves as a support for a series of alternately moving blades 8a and 8b which are intended to constitute the grippers for plucking-out hairs to be removed. In the example shown, said blades are flat and each have the general shape of an arch (as shown in FIG. 3).

Said blades are mounted one after the other on the support 2 in the form of two rows disposed radially on each side of the central axis X—X'. For the sake of clarity of the drawings, only one of these rows is shown in FIGS. 1 and 2, the other row being located on the opposite side but along the same diameter.

In each of these rows, the blades 8a and 8b are disposed at right angles to the corresponding radius OA. In consequence, they are tangent to the various concentric circles which pass through the corresponding points of said radius OA. This is an important feature for ensuring correct engagement of hairs between said blades and efficient subsequent gripping of said hairs.

Figure 3:
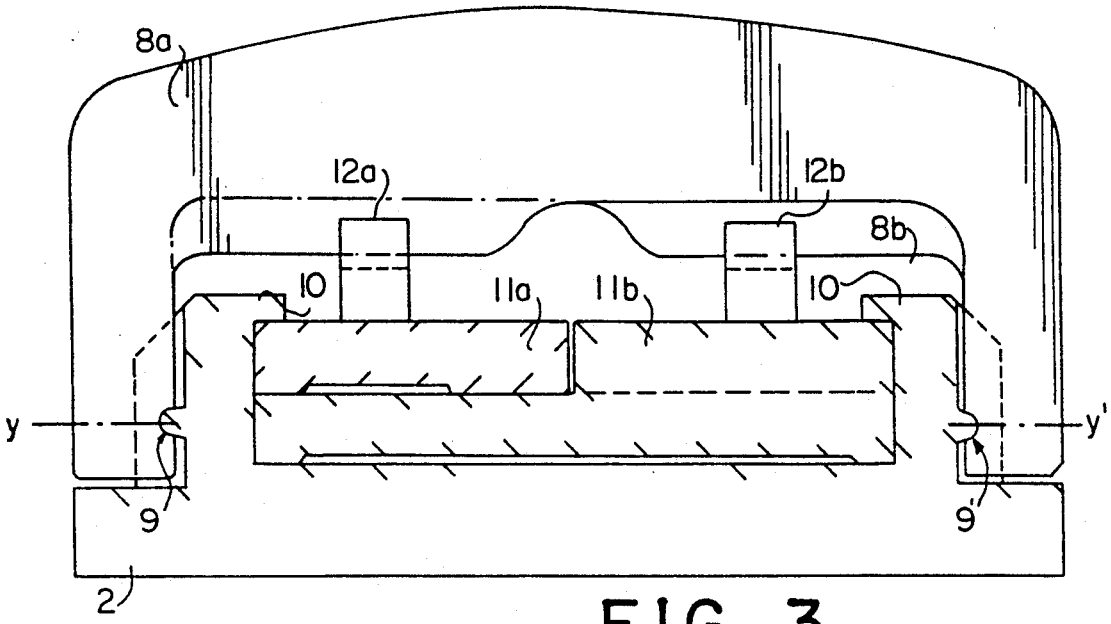
FIGS. 3 and 4 are sectional views taken respectively along line III—III and line IV—IV of FIG. 2.
Figure 4:
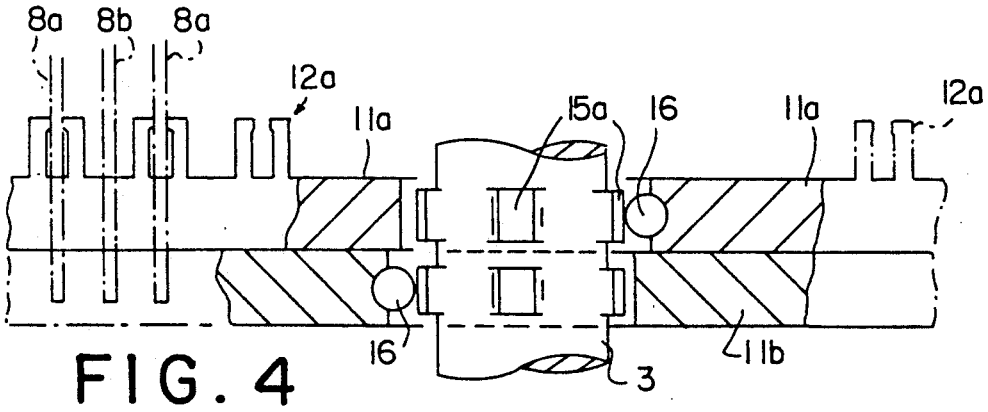

As shown in FIG. 3, each blade 8a or 8b is pivotally mounted at its lower end or foot on bosses 9 formed on the internal faces of two parallel ribs 10 carried by the top face of the rotary plate 2. Said bosses are engaged in recesses formed in the inner edges of the lateral arms of the blades 8a and 8b. As a result of this arrangement, the different blades are mounted for pivotal displacement about a series of axes Y—Y' all disposed at right angles with respect to the corresponding radius OA.

Figure 2:
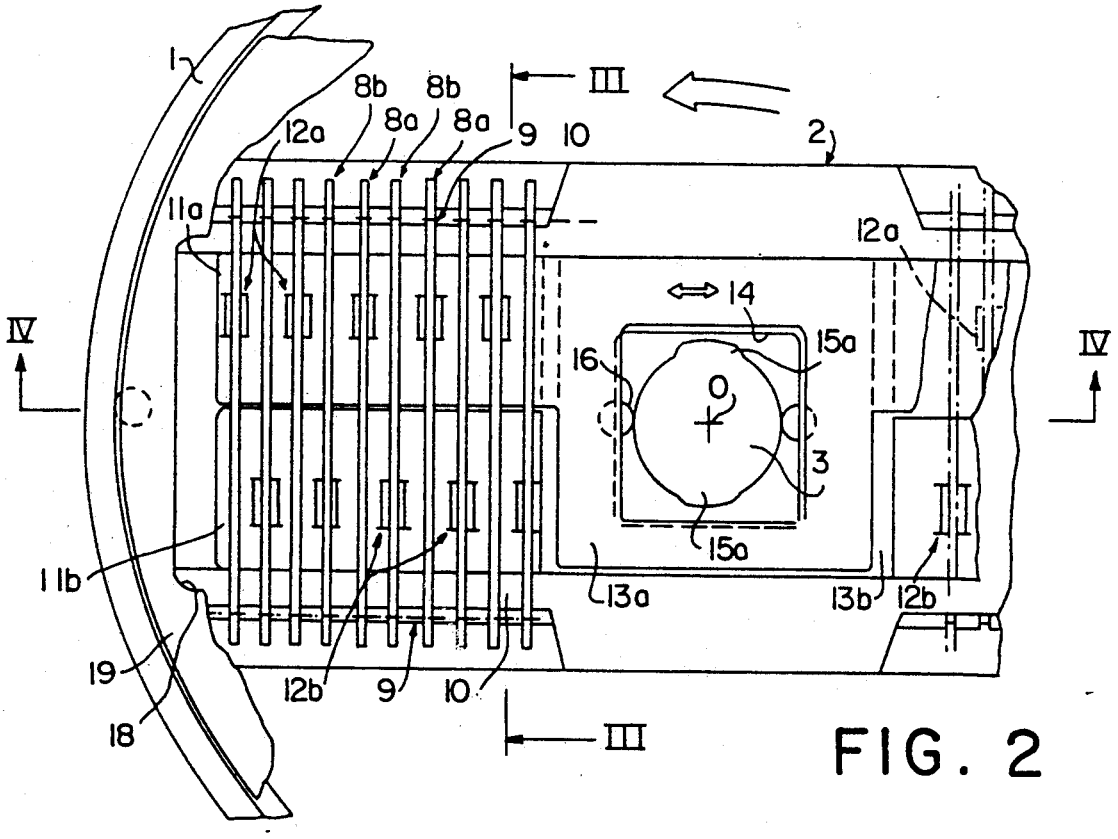
FIG. 2 is a fragmentary top view of said appliance.

In order to produce the gripping action of the free edges of said blades as shown in FIG. 1, said blades are actuated by mechanical means which are capable of causing them to pivot towards each other during rotation of the plate 2 which supports the complete assembly. These actuating means consist of two flat bars : one bar 11a is associated with the blades 8a whilst the other flat bar 11b is associated with the blades 8b, respectively in each of the two rows located on each side of the axis X—X'. The top face of each bar is adapted to carry a small fork 12a or 12b within which is engaged the internal edge of the corresponding blade 8a or 8b. As shown in FIG. 3, the internal edge of each blade 8a and 8b is cut-out differently so as to be gripped by the forks 12a and 12b which have relatively displaced positions.

Each flat bar 11a and 11b has a central portion 13a or 13b of square shape comprising a recess 14 within which is located the top end of the stationary shaft 3. These two central portions 13a and 13b are superposed, the two bars 11a and 11b being provided with a special cut-out portion for this purpose. In point of fact, at the levels corresponding to each of these two central portions 13a and 13b, the end of the stationary shaft 3 is adapted to carry bosses 15a and 15b constituting cams which are capable of acting on the opposite portions of the corresponding flat bars 11a and 11b during each revolution of the moving support plate 2 of the unit. The corresponding edges of the central portions of the bars can advantageously comprise balls 16 placed in contact with the end of the stationary shaft 3.

Thus the bosses 15a and 15b are capable of exerting thrust on each flat bar in order to subject these latter to an outward sliding movement. However, provision is made for conventional restoring springs (not shown) which tend to return said bars in the opposite direction.

The arrangement thus provided is such that, twice per revolution of the movable support plate 2 of the unit, one of the flat bars is thrust back in one direction and the other bar is thrust back in the opposite direction. This causes a pivotal displacement of the blades 8a and 8b alternately in one direction and in the other so that their free edges are applied against each other, as shown in FIG. 1.

Prior to this clamping action and therefore prior to closure of the grippers constituted by said blades, the free edges of these latter are outwardly withdrawn with respect to each other. Under these conditions, the hairs of the corresponding zone of the skin have accordingly been able to engage between said blades. At the time of closure of the grippers, these hairs are trapped and, since the grippers subsequently remain closed during a fraction of the corresponding revolution of the support plate 2, the hairs are thus pulled and consequently plucked-out.

It is worthy of note that engagement of the hairs between the blades 8a and 8b takes place under optimum conditions by reason of the special arrangement of said blades and specifically the fact that these latter are tangent to the different concentric circles described by the points of intersection with the corresponding radius OA. In fact, this arrangement has the advantage of first "combing" the hairs in a direction which facilitates their subsequent engagement between the gripping blades 8a and 8b.

In order to avoid direct contact of the shaft 3 with the skin, said shaft can advantageously be fitted with an end-cap 17 carried by radial arms 18 rigidly fixed to a ring 19, said ring being separately mounted on the free edge of a cylindrical skirt 20 which is rigidly fixed to the rotary support plate 2.

However, the appliance considered can be provided with various other improvements and may form the subject of many alternative embodiments, especially the following improvements and variants :

1) In order to protect the skin and more precisely in order to prevent the skin from engaging in the space provided for the motion of the depilating grippers, provision can be made for a certain number of cylinder sections, the free edge of which is located in the same plane as the free edge of said grippers, or even slightly in front. These sections of cylinders may rotate with the depilating grippers, in which case the rectangular plate 2 which serves as a support for the grippers is replaced by a disk and said cylinder sections are fixed on this latter within the space existing between the rows of grippers.

2) Instead of being flat, the blades 8a and 8b could be curved. Furthermore, they could correspond if necessary to concentric sections of cylinders having a center O.

In such a case, the protective cylinder sections mentioned earlier could be stationary by being placed within the intervals between the grippers. These sections of cylinders could in that case be carried by the radial arms 18 which are rigidly fixed to the end-cap 17. However, any other suitable arrangement could be contemplated in this connection.

3) As can readily be understood, the number of radial rows of depilating grippers could be different from the number proposed in the embodiment described earlier. Thus it would be possible to provide four rows of such grippers arranged in a cross.

Moreover, it would also be possible to provide a different number of stages of opening and closing of the depilating grippers during each revolution of the moving system.

4) the blades constituting the depilating grippers could have a shape other than that of an arch as is the case in the example described earlier. In fact, these blades could be mounted differently on the rotary support plate of the unit so as to be capable of pivoting in one direction and in the other while being actuated by the sliding bars 11*a* and 11*b* or any other suitable mechanical means.

5) The cams 15*a* and 15*b* which control the sliding bars 11*a* and 11*b* could be replaced by cams provided at the periphery of the moving system and capable of acting on the outer ends of said bars. In this case also, these cams could control a more or less substantial number of distinct stages of closing and opening of the depilating grippers.

6) Instead of being rotatably mounted on a stationary shaft 3, the movable support plate 2 of the system could be rigidly fixed to a rotary central shaft coupled with the output shaft of the drive motor. In such a case, the cams controlling the sliding bars 11*a* and 11*b* must necessarily be provided at the periphery of the moving system.

Figure 5:
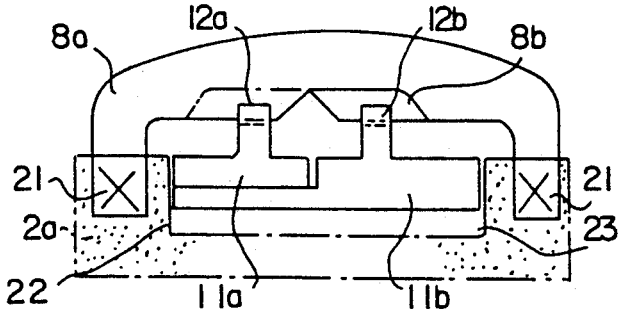
FIG. 5 is a view which is similar to FIG. 3 but to a different scale, and illustrates another embodiment of the present appliance.

7) Instead of being pivotally mounted on the rotary support 2, the feet 21 of the gripping blades 8*a* and 8*b* could be embedded in a support 2*a* of this type by overmolding of plastic material on said feet as shown in FIG. 5. These blades could then have a sufficient degree of elasticity to be applied against each other at their free edges by bending under the action of the sliding control bars 11*a* and 11*b* at the time of displacement of these latter in opposite directions.

The operation of the corresponding appliance is in this case the same as before. In order that the sliding control bars 11*a* and 11*b* may be mounted in position, the support 2*a* has a groove 22 of greater depth than the thickness of the bars. After positioning of said bars, a rule 23 is then engaged beneath these latter.

8) Instead of being pivotally or deformably mounted on a support 2 or 2*a*, the gripping blades could be rigid and secured alternately to each of two supporting and actuating bars which slide in opposite directions in the same manner as the bars 11*a* and 11*b*, on a rotary support such as the plate 2 or a disk which replaces this latter.

In such a case, the pinching action of the free edges of said blades would be ensured simply by the sliding movement of said bars in opposite directions. In this case also, provision would be made for control means such as cams for example, which would be capable of causing the sliding displacement of said bars in opposite directions either once or a number of times during each revolution of the moving system.

Once again, however, many other alternative forms of construction could be contemplated for the present appliance.

Thus FIGS. 6 and 7 illustrate yet another embodiment in which the gripping blades which form the hair-plucking grippers are constructed in accordance with a very different design. In fact, these blades are formed by strips cut from a band or plate of resilient material, this being carried out by forming a series of parallel slits in a plate of this type.

In the example of FIGS. 6 and 7 under consideration, there exist two work rotors which are constructed in a similar manner. Each rotor comprises a plate 24*a* or 24*b* of resilient material having the general shape of a rectangle and extending along a diameter of the corresponding rotor. Each of these plates is driven in rotation by the head 25 of a central shaft 26. Each of these two shafts is adapted to carry a toothed wheel 27 disposed in meshing engagement with a pinion 28 carried by the shaft of a drive motor 29. Moreover, the ends of these two shafts are slidably mounted in the wall 30 of the corresponding end of the body 31 of the appliance.

The diametral plate 24*a* or 24*b* of each rotor is placed within a support 31*a* or 31*b* having the general shape of a rectangle. The hollowed-out bottom portion of each of these supports has an annular rib 32, two radial rules 33 being placed in contact with said rib beneath the two radial portions of each diametral plate 24*a* or 24*b* of resilient material. At the end 34 located nearest the center of each rotor, the rules 33 are engaged beneath the enlarged head 25 of the corresponding rotary shaft 26.

Beneath the lower end of the two rotors, provision is made for a stationary plate 35 separately mounted on the corresponding end of the body 31 of the appliance. Opposite to the annular ribs 32 of the cup 31*a* or 31*b* of each rotor, the plate 35 is provided with a groove 36 and bearing balls 37 are interposed at this location.

As has already been mentioned, each diametral plate 24*a* or 24*b* of resilient material is provided with a series of slits 38 which delimit a corresponding number of gripping strips 39. For the sake of enhanced clarity of the drawings, however, a limited number of these slits and gripping strips is shown in FIGS. 6 and 7. All the slits 38 are formed approximately at right angles with respect to the corresponding diameter. These slits are formed in only a part of the thickness of the plates 24*a* and 24*b*, namely in their outer portion so as to open to the exterior. Advantageously, their opposite ends open into an internal cavity 38*a*. Said slits accordingly delimit a corresponding number of parallel gripping strips 39 and these latter are intended to constitute the movable gripping blades which form the hair-plucking grippers of each work rotor.

In the state of rest (position shown in FIG. 6 in the case of the left-hand rotor), the outer face of the plate 24*a* or 24*b* of resilient material has a convex shape and the slits 38 are then freely open to the exterior. In this position, the strips 39 which form gripping blades are therefore held away from each other, with the result that the hairs to be plucked-out can engage therein whilst the rotary drive shaft 26 is located in its top position at this moment.

However, the same gripping strips 39 can be applied against each other so as to form hair-plucking grippers, this being achieved by contraction of the corresponding resilient plate 24*a* or 24*b*. This in fact corresponds to the state of the resilient plate 24*b* of the right-hand rotor in FIG. 6.

To this end, suitable control means are provided for producing, at each revolution of each rotor, an axial displacement of the corresponding rotary shaft 26 in the direction F and then in the opposite direction. In the example shown in FIG. 6, these control means consist of an annular cam 40 formed on a collar which is rigidly fixed to the plate 35. Each shaft 26 is also adapted to carry a bearing ring 41 fitted with rollers 42 which are placed in contact with the corresponding cam 40.

When one of the shafts 26 is displaced in the direction of the arrow F as shown on the right-hand side of FIG. 6, the enlarged head 25 of said shaft applies pressure on the central ends 34 of the rules 33. These rules are then caused to pivot on the top face of the corresponding annular rib 32 in the same manner as levers. In consequence, their outer ends exert a pressure on the corresponding portion of the plate 24*a* or 24*b* of resilient material. This accordingly results in contraction of the plate and consequently in a clamping action of the gripping strips 39.

The operation of each hair-plucking rotor is finally the same as in the embodiments described earlier. In fact, after the hairs have been gripped between the strips 39, they are plucked-out by reason of the rotation of each corresponding rotor.

The plate 24*b* of the right-hand rotor (FIGS. 6 and 7) differs from the plate 24*a* of the left-hand rotor in the fact that each of its radial portions has a wide triangular slot 43 which delimits two separate and distinct arms 44. In such a case, the parallel slits 38 between the gripping strips 39 are formed in both of these two arms. This accordingly increases the number of gripping strips even further. In order to guard against any danger of pinching or injury to the skin during rotation of each rotor, full portions 45 which rotate with the corresponding rotor can be provided on each side of each diametral plate 24*a* or 24*b*. Thus the presence of these full portions prevents the skin from engaging within the gaps existing on each side of a rotary diametral plate 24*a* or 24*b*.

As can readily be understood, the embodiment shown in FIGS. 6 and 7 has the advantage of greater simplicity with respect to the embodiments described earlier. This is clearly due to the fact that, instead of being constituted by separate blades mounted on a common support, the gripping blades are formed of resilient material in a single piece which is simply provided with parallel slits, thus giving rise to gripping strips placed side by side with a small interval between them. This accordingly results in considerable simplification of the mechanism and consequently in an appreciable reduction of the cost price.

Figure 8:
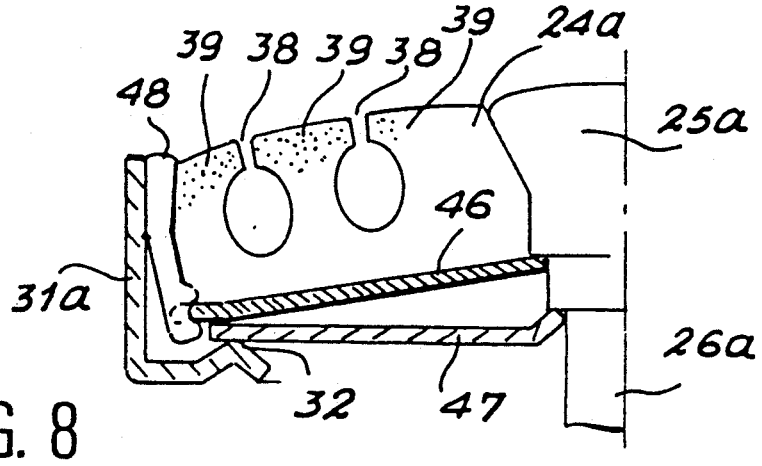
FIG. 8 is a partial axial sectional view of an alternative embodiment of the appliance shown in FIGS. 6 and 7.
Figure 9:
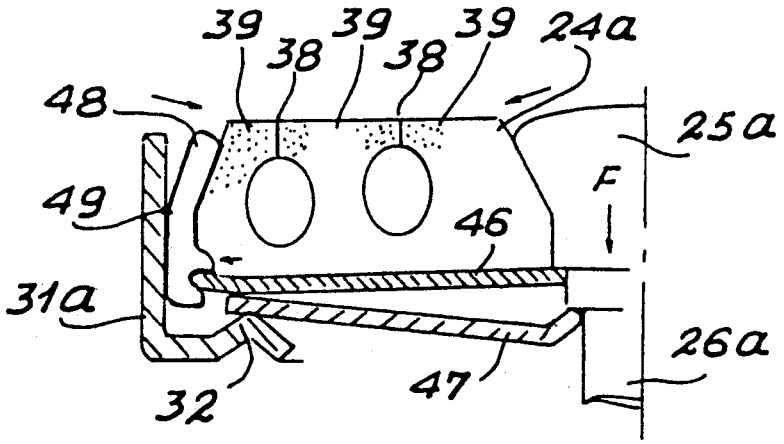
FIG. 9 is a corresponding view illustrating another position of operation of the corresponding appliance.
Figure 10:
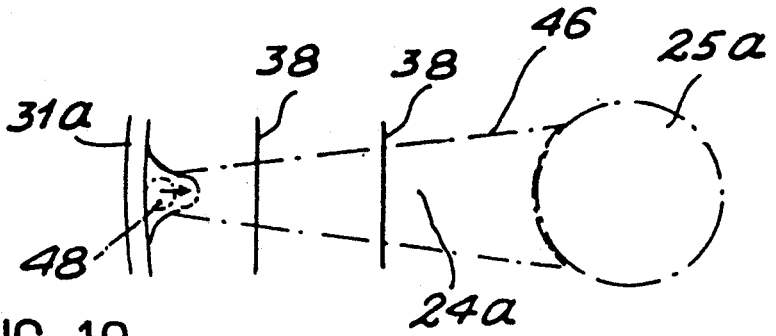
FIG. 10 is a schematic top view of the alternative embodiment shown in FIGS. 8 and 9.

FIGS. 8 to 10 illustrate a variant of the embodiment of FIGS. 6 and 7. This variant differs from the preceding in the fact that the radial rules 33 are replaced by two superposed rules 46 and 47 which can be actuated by separate shouldered portions of the enlarged head 25*a* of the corresponding rotary shaft 26*a*, namely at the time of sliding displacement of said shaft in the direction of the arrow F. The rules 47 are capable of pivoting on the top portion of the annular rib 32 of the bottom end of the support 31*a* of the corresponding plate 24*a* of resilient material. As to the radial rules 46, they are slightly elbowed at their outer ends and are thus capable of pivoting at this point on the corresponding end of the lower rule 47. The end of each rule 46 is adapted to carry a small clamping lever 48 which extends against the corresponding end of the plate 24*a* of resilient material. Each of these levers is elbowed and is thus capable of pivotal displacement at 49 against the internal wall of the cup-shaped support 31*a*.

When the corresponding shaft 26*a* is located in the position illustrated in FIG. 8, the parallel slits 38 formed in the plate 24*a* are wide open and the outer face of said plate has a convex shape. On the other hand, when the shaft 26*a* is displaced in the direction of the arrow F, this produces a pivotal displacement of the radial rules 46 which in turn cause the small clamping levers 48 to pivot about their point of articulation 49. These levers thus cause contraction of the resilient plate 24*a*, thereby closing the parallel slits 38 and consequently producing a clamping action of the gripping strips 39 as shown in FIG. 9.

In consequence, the operation of the appliance is finally the same as in the embodiment previously described.

However, while at the same time making use of the work rotors constituted by a plate having parallel slits which delimit a corresponding number of gripping strips, it is possible to provide different mechanical systems in order to obtain contraction of said plate during each revolution in order to pinch the hairs which have engaged between the gripping strips when these latter were separated from each other.

What is claimed is:

1. A depilating appliance comprising a series of hair-plucking grippers constituted by blades carried by a movable support, said blades being driven in movements which cause them successively to be applied against each other for gripping the hairs to be plucked-out and to open-out so as to permit the preliminary introduction of said hairs between said blades, wherein :

the support for the gripping blades constituting the hair-plucking grippers consists of a substantially flat member driven in a movement of rotation about a central shaft at right angles to said member, the gripping blades are mounted on said support in the form of one or a number of rows disposed radially, are placed in each row at right angles with respect to the corresponding radius of rotation, and are movably mounted in such a manner as to ensure that their free edges can be alternately applied against each other or opened-out, means are provided for actuating said blades and are capable of causing the grippers constituted by said blades to open and close at least once per revolution.

2. A depilating appliance according to claim 1, wherein the means for actuating the movable blades constituting the hair-plucking grippers are constituted in the case of each row of blades by two flat bars slidably mounted on the rotary support of said blades and driven in movements of translation in opposite directions, said flat bars being each provided with a fork in which is engaged a portion of the corresponding blade to be actuated.

3. A depilating appliance according to claim 2, wherein the sliding bars which actuate the movable gripping blades are themselves controlled by fixed cams placed opposite to the ends of said bars.

4. A depilating appliance according to claim 3, wherein the cams for controlling the bars which actuate the gripping blades are provided on the end of the stationary central shaft on which the movable blade support is rotatably mounted.

5. A depilating appliance according to claim 2, wherein the movable blades constituting the grippers are flat and have the general shape of arches- which are pivotally mounted at their ends on the blade support, the actuating bars being capable of initiating the pivotal displacement of said blades alternately in one direction and in the other so as to close the grippers constituted by the ends of said blades.

6. A depilating appliance according to claim 2, wherein the gripping blades are flexible and the feet of said blades are fixed on their rotary support, the actuating bars being capable of producing flexural deformation of said blades alternately in one direction and in the other so as to close the grippers constituted by the ends of said blades.

7. A depilating appliance according to claim 2, wherein the gripping blades are carried by the actuating bars, each blade being coupled alternately to one of said bars and to the other so as to ensure that the sliding motion of said bars in opposite directions initiates closure of the grippers constituted by the ends of said blades.

8. A depilating appliance according to claim 1, wherein the gripping blades forming the hair-plucking grippers are formed by strips in which are cut parallel slits in a band or plate of resilient material which is driven in rotation about a central axis and means are provided for causing deformation of said band or plate during each revolution in order to carry out in alternate sequence the closure and separation of the cut strips which form gripping blades.

9. A depilating appliance according to claim 8, wherein the central shaft for driving in rotation the plate of resilient material provided with the cut gripping strips is slidably mounted in the axial direction and the arrangement is such that its sliding motion in one direction and in the other causes deformation of said plate either directly or indirectly and in such a manner as to carry out the closure and separation of the gripping strips in alternate sequence.

10. A depilating appliance according to claim 9, wherein the sliding motion of the rotary shaft in one direction and in the other is controlled by a fixed annular cam placed around said shaft, a rotary bearing ring which is rigidly fixed to said shaft being placed in contact with said cam.

11. A depilating appliance according to claim 9, wherein the diametral plate of resilient material provided with cut gripping strips is placed within a cup-shaped support, the hollowed-out bottom portion of which has an annular rib against which radial rules forming levers placed beneath the diametral plate of resilient material are capable of pivotal displacement, the corresponding end of the rotary shaft being adapted to carry an enlarged head which is capable of applying pressure on said rules in order to cause them to pivot and thus to initiate contraction of the diametral plate of resilient material.

12. A depilating appliance according to claim 9, wherein the diametral plate of resilient material provided with cut gripping strips is placed within a cup-shaped support, the hollowed-out bottom portion of which is adapted to carry elbowed radial rules, the ends of which are coupled with small levers placed against both ends of the corresponding diametral plate, the enlarged head of the rotary shaft being capable of applying pressure on said rules which thus produce a pivotal displacement of the small end levers in order to cause said levers to initiate contraction of the diametral plate of resilient material.

13. A working head for a depilating appliance, which comprises a series of hair-plucking grippers constituted by blades carried by a movable support, said blades being mounted on said support for movements which cause them successively to be applied against each other so as to grip hairs to be removed and to open-out so as to permit preliminary introduction of said hairs between said blades, wherein:

the support of the gripping blades constituting the hair-plucking grippers consists of a substantially flat member driven in a movement of rotation about a central shaft at right angles to said member, the gripping blades are mounted on said support in the form of at least one radially-disposed row and placed in each row at right angles with respect to the corresponding radius of rotation and said blades are movably mounted so that their free edges can be alternately applied against each other or opened-out, and means for actuating said blades for closing and opening of the grippers constituted by said blades, at least once per revolution.

* * * * *